US006135807A

United States Patent [19]

Lai et al.

[11] Patent Number: 6,135,807

[45] **Date of Patent: *Oct. 24, 2000**

[54] STRAIN RELIEF DEVICE FOR ELECTRICAL CABLE CONNECTOR ASSEMBLY

[75] Inventors: C. T. Lai, Tao-Yuan Hsien, Taiwan; Gordon Lok, Montebello; Haw-Chan Tan, Diamond Bar, both of Calif.

[73] Assignee: Hon Hai Precision Ind. Co., Ltd., Taipei Hsien, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 09/006,103

[22] Filed: Jan. 13, 1998

Related U.S. Application Data

[63] Continuation-in-part of application No. 08/979,046, Nov. 26, 1997, Pat. No. 6,024,597.

[51] Int. Cl.[7] ..... H01R 13/58

[52] U.S. Cl. ..... 439/455

[58] Field of Search ..... 439/455, 449, 439/442

[56] References Cited

U.S. PATENT DOCUMENTS

| | | | |
|---|---|---|---|
| 4,310,213 | 1/1982 | Fretteolf, Sr. et al. | 339/103 |
| 4,940,262 | 7/1990 | Baracat et al. | 285/114 |
| 4,945,193 | 7/1990 | Oikawa et al. | 174/153 |
| 4,990,103 | 2/1991 | Sazaki et al. | 439/455 |
| 5,667,390 | 9/1997 | Keng | 439/76.1 |
| 6,004,150 | 12/1999 | Chapman et al. | 439/189 |

*Primary Examiner*—Paula Bradley
*Assistant Examiner*—Truc Nguyen

[57] ABSTRACT

An electrical cable connector assembly includes a connector and a cable. The connector includes a housing enclosing an insulator with contacts fixed thereto. The cable has a number of wires with leads electrically connected to the contacts. A plastic strain relief is fixedly attached to the cable by insert molding, and has two keys engagably received within two grooves defined by the housing. A metal strain relief is formed by stamping a metal sheet to have a hollow body portion and two fitting wings extending from opposite sides thereof. The body portion is crimped to be fixedly connected to the cable near the plastic strain relief. The wings are fittingly received between a stop wall and either a connecting post or sleeve formed on a lower housing member of the housing. Through cooperation between the metal and plastic strain reliefs, a large withdrawal force acting on the cable relative to the connector can be effectively transmitted to the housing to prevent the withdrawal force from affecting the leads of the cable.

1 Claim, 9 Drawing Sheets

STRAIN RELIEF DEVICE FOR ELECTRICAL CABLE CONNECTOR ASSEMBLY

CROSS-REFERENCED APPLICATION

This application is a Continuation-in-Part (C-I-P) application of U.S. patent application Ser. No. 08/979,046, filed on Nov. 26, 1997 by Gordon Lok with a title "CABLE CONNECTOR ASSEMBLY WITH A SHUNTING BAR FOR SHORT-CIRCUITING", which has been granted on Feb. 15, 2000 as U.S. Pat. No. 6,024,597.

BACKGROUND OF THE INVENTION

1. Field of the Invention

The present invention relates to a strain relief device for an electrical connector assembly, and particularly to an electrical cable connector assembly which can effectively withstand a withdrawal force acting on a cable relative to a connector thereby preventing a separation of leads of the cable from contacts of the connector.

2. The Prior Art

An electrical cable connector assembly generally includes a connector and a cable which is insert molded with a plastic strain relief thereon. The connector has a housing and a number of contacts fixedly received in the housing. The cable has a number of wires with leads extending into the housing and connected to the contacts. The plastic strain relief is connected to the housing of the connector by some means, whereby a withdrawal force exerted on the cable is transmitted to the housing of the connector via the plastic strain relief, rather than directly to the wires. Thus, the withdrawal force will not cause the leads to be separated from the contacts.

Such designs are disclosed in U.S. Pat. Nos. 4,838,810, 5,100,341 and 5,609,499.

However, due to structural and material limitations, the conventional plastic strain relief generally cannot achieve a secure connection with the housing of the connector to effectively withstand a large withdrawal force acting on the cable. When a large withdrawal force is exerted on the cable, the plastic strain relief often becomes disengaged from the housing of the connector, which causes the withdrawal force to be totally and directly applied to the leads, resulting in a separation of the leads from the contacts. When this happens, electrical signal transmission by means of the cable connector assembly is interrupted.

Hence, an improved strain relief device is needed to eliminate the above mentioned defect of current cable connector assemblies, which can effectively withstand a large withdrawal force acting on the cable relative to the connector to prevent the withdrawal force from affecting the leads connected to the contacts.

SUMMARY OF THE INVENTION

Accordingly, an objective of the present invention is to provide a strain relief device for a cable connector assembly. The strain relief device includes a plastic and metal strain relief which, in cooperation, can effectively withstand a large withdrawal force acting on a cable of the connector assembly relative to a connector thereof.

Another objective of the present invention is to provide a metal strain relief for a cable connector assembly which has a simple structure formed by stamping a metal sheet, and can effectively withstand a withdrawal force acting on a cable of the connector assembly.

Still another objective of the present invention is to provide a metal strain relief for a cable connector assembly which can be easily and conveniently fixed to a cable of the connector assembly and mounted to a housing of a connector thereof, and can effectively withstand a withdrawal force acting on the cable relative to the connector to prevent the withdrawal force from affecting leads of the cable connected to contacts of the connector.

To fulfill the above mentioned objectives, according to one embodiment of the present invention, an electrical cable connector assembly includes a connector and a cable. The connector includes a dielectric housing consisting of an upper and lower housing member, an upper and lower shielding shell interconnected and located within a middle portion of the housing, and an insulator fixed between the upper and lower shielding shells and mounted with a number of long and short contacts each having a contact and terminal portion. An upper and lower spacer are respectively fixed to a top and bottom face of the insulator and define slits for receiving the terminal portions of the contacts. A coupling section is fitted to a blade section of the insulator receiving the contact portions of the contacts for electrically connecting with contacts of a mating connector. A shell is connected to the insulator and the coupling section to electromagnetically shield the contact portions of the contacts. The cable includes a number of wires with leads electrically connected to the terminal portions of the contacts. A shorting bar is mounted in the lower spacer and has a number of piercing lances selectively connecting some of the leads thereby shorting the selected wires to meet a specified requirement. The cable further has a plastic strain relief fixedly attached thereto by insert molding. The plastic strain relief has two keys engagably received in two grooves defined by two mounting blocks of the housing of the connector. A metal strain relief is made by stamping a metal sheet and has a substantially elliptical hollow body portion and two fitting wings extending from opposite sides of the body portion. The body portion is crimped to be fixed to the cable. The two wings are fittingly received on two supports between a stop wall and either a connecting post or sleeve formed on the lower housing member. By means of the metal and plastic strain relief, a large withdrawal force acting on the cable relative to the connector can be effectively transmitted to the housing to prevent the withdrawal force from affecting the leads of the cable.

DETAILED DESCRIPTION OF THE PREFERRED EMBODIMENTS

Reference will now be made in detail to the preferred embodiment of the present invention.

Figure 1:
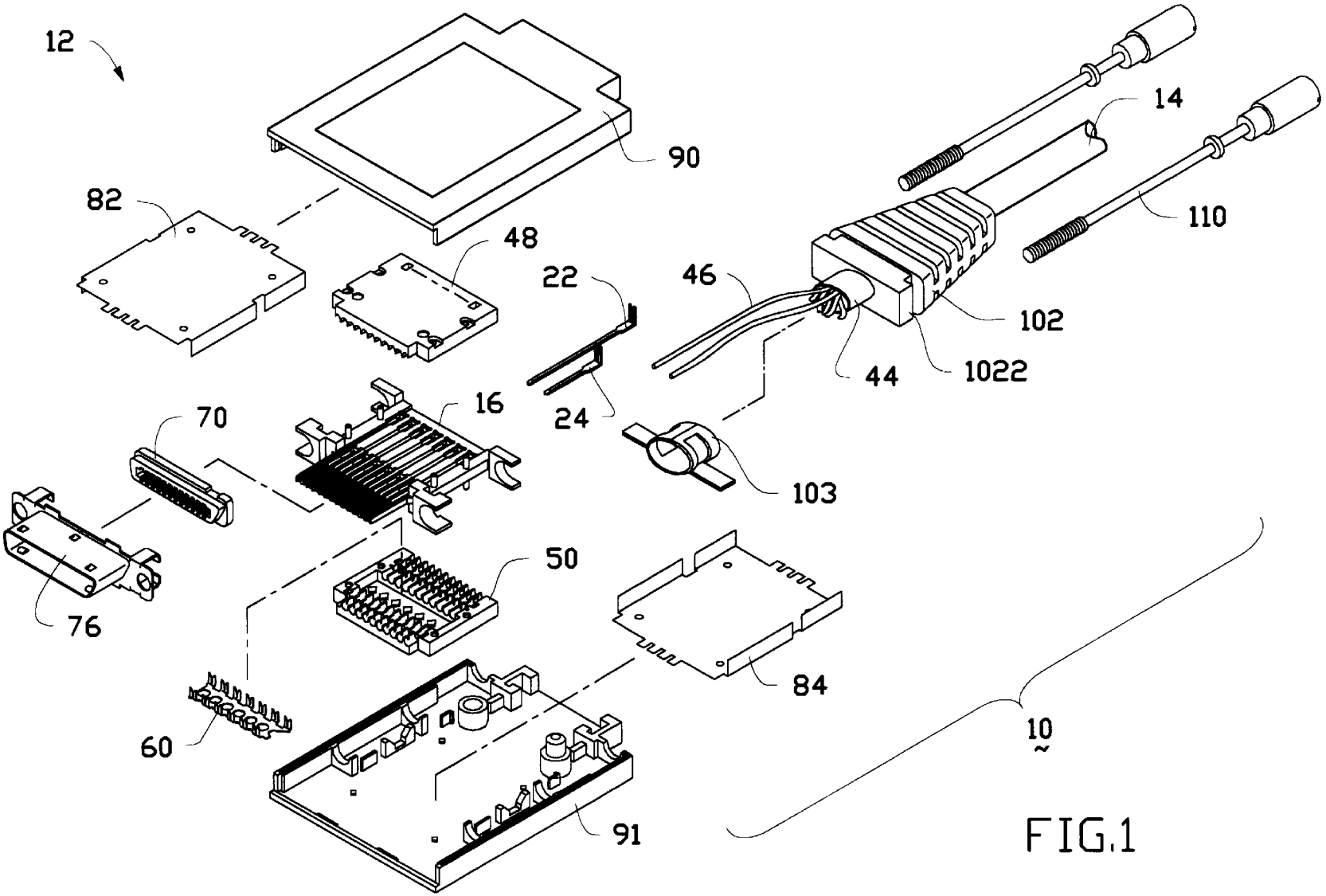
FIG. 1 is a perspective, exploded view showing components constituting an electrical cable connector assembly including a metal strain relief in accordance with the present invention.
Figure 2:
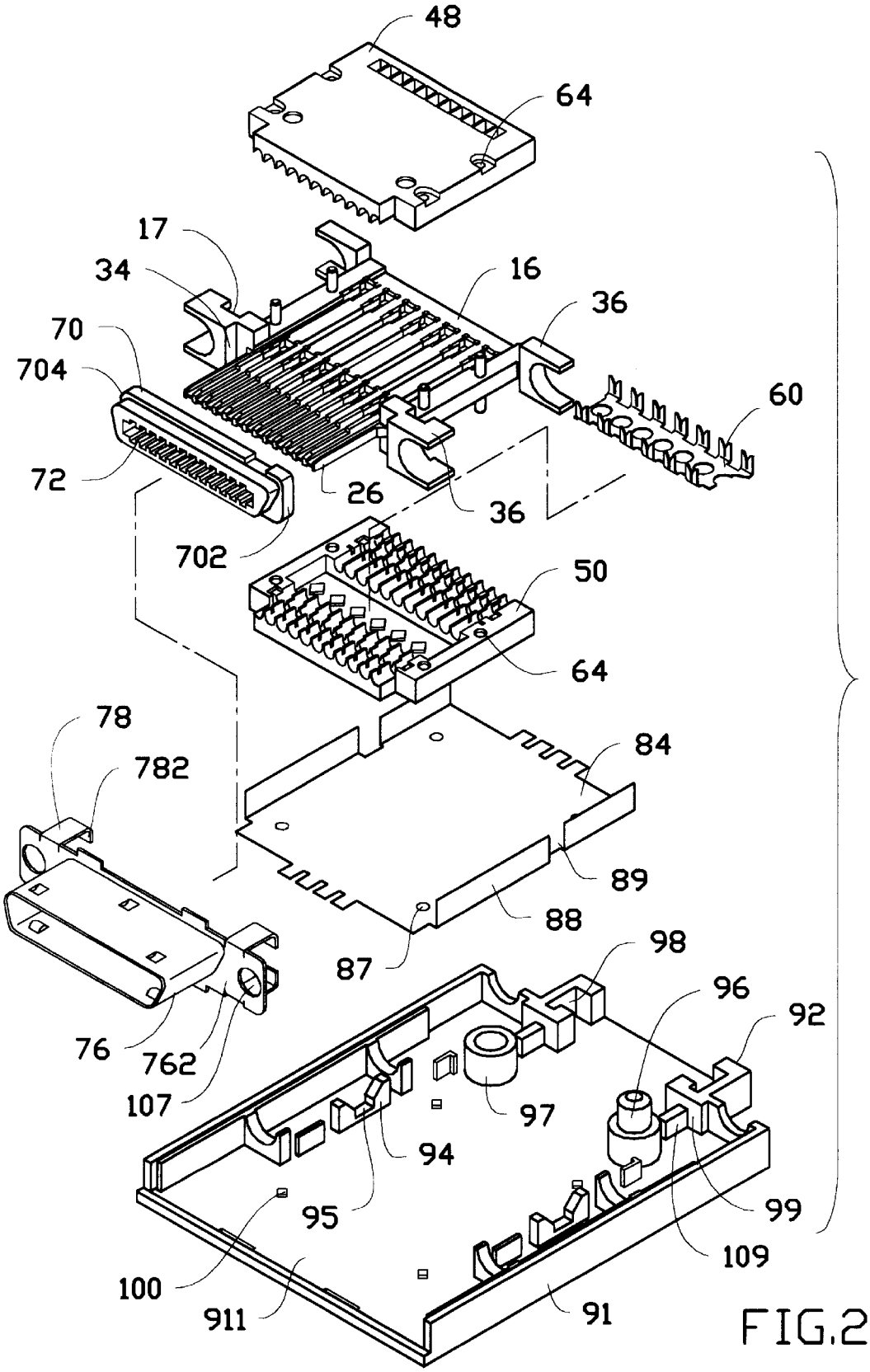
FIG. 2 is a partial enlarged view of FIG. 1 showing some components more clearly.

Referring to FIGS. 1 and 2, an electrical cable connector assembly 10 includes a connector 12 and a cable 14. The cable 14 includes a number of wires 46 extending from a front end 44 thereof. Each wire 46 has a conductive lead (not shown) therein. Furthermore, a plastic strain relief 102 is fixedly attached to the cable 14 by insert molding. The plastic strain relief 102 forms two keys 1022 at two lateral sides of a front end thereof, respectively.

Figure 3:
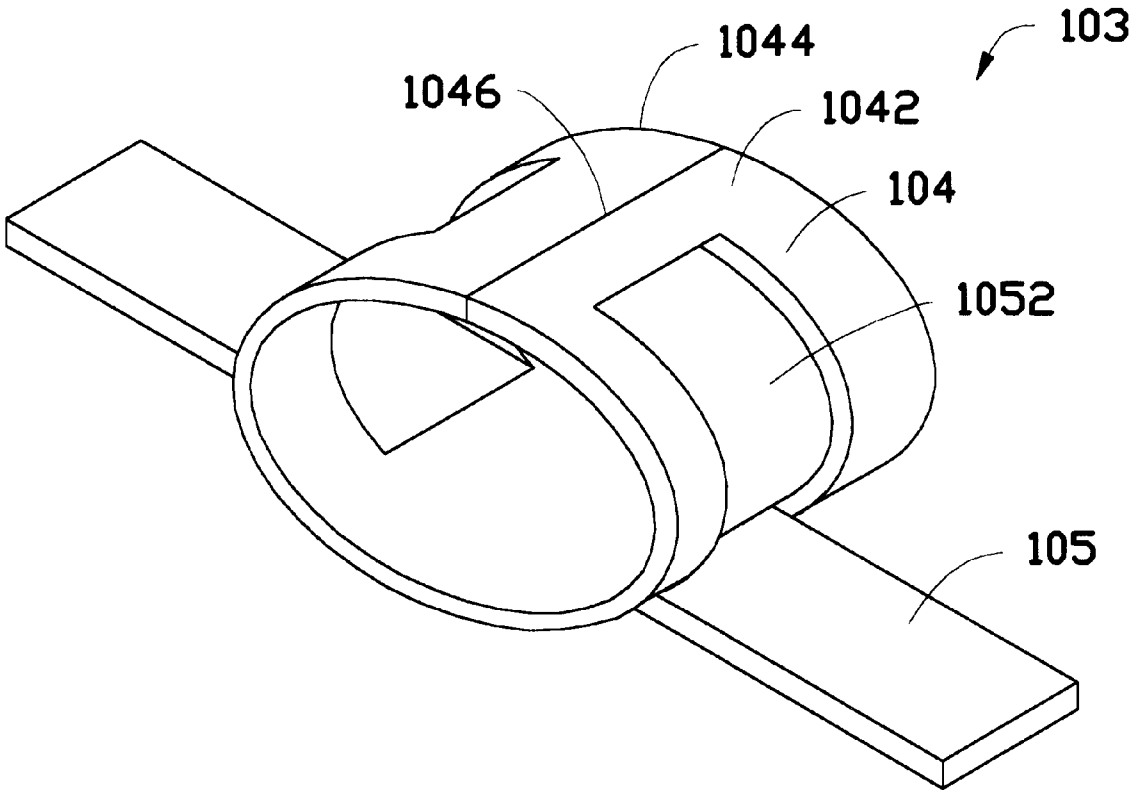
FIG. 3 is an enlarged perspective view of the metal strain relief.

Also referring to FIG. 3, a metal strain relief 103 formed by stamping a metal sheet, has an elliptical hollow body portion 104 having two edges 1042, 1044 confronting each other and defining a slit 1046 therebetween, and a pair of rectangular fitting wings 105 extending from opposite sides of the body portion 104 and substantially in alignment with each other. Since the two fitting wings 105 are integrally formed with the body portion 104 by a stamping operation, two complementary holes 1052 are defined in the body portion 104.

Particularly referring to FIG. 1, the connector 12 includes an upper and lower housing member 90, 91 formed by plastic molding, an upper and lower shielding shell 82, 84 made from a metal sheet, an upper and lower spacer 48, 50 formed by plastic molding, an insulator 16 formed by plastic molding, a coupling section 70 formed by plastic molding, a number of long and short conductive contacts 22, 24 (only one each is shown), a shorting bar 60 made from a metal sheet, a shell 76 made from a metal sheet, and two screws 110.

Figure 4:
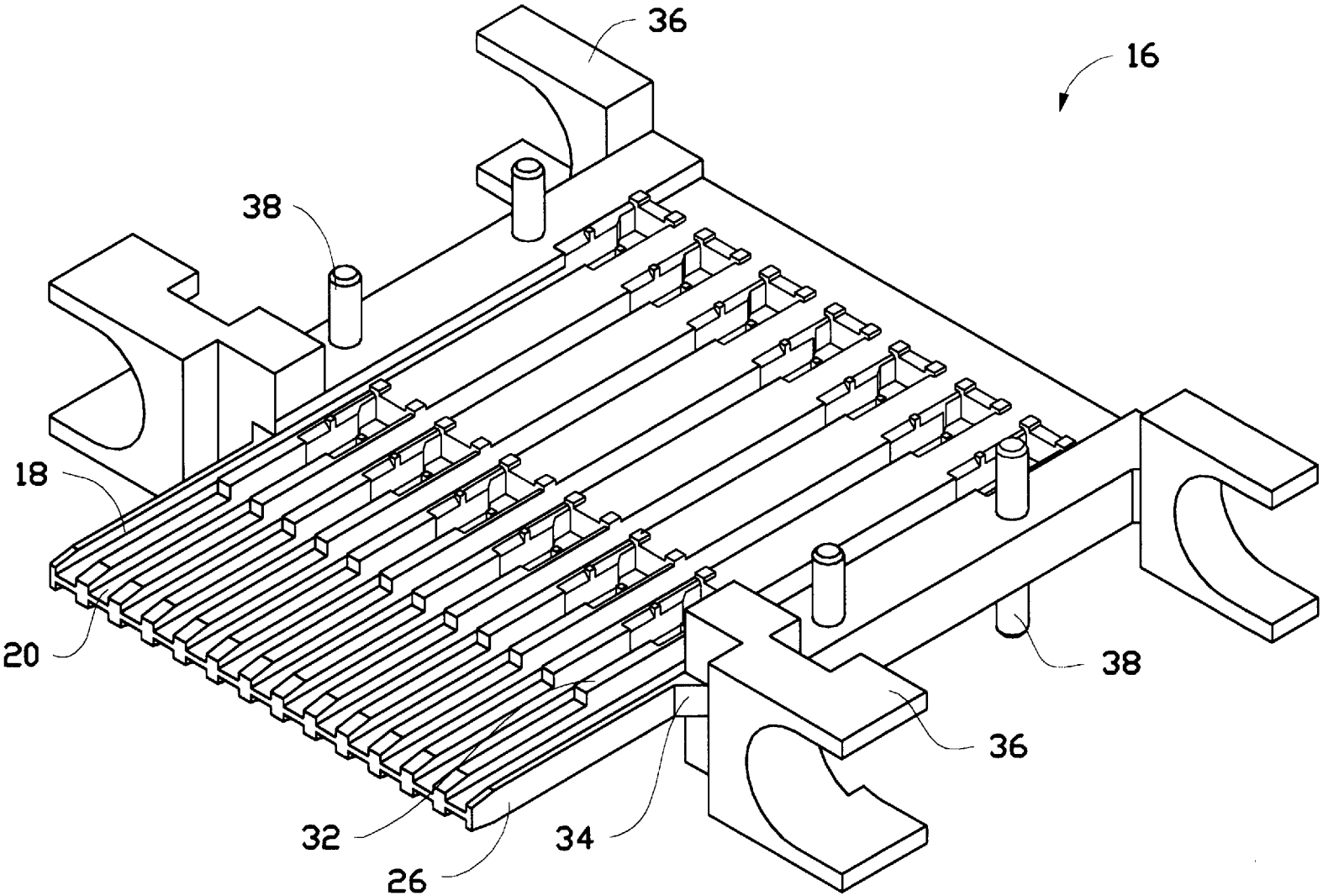
FIG. 4 is an enlarged perspective view of an insulator.

Also referring to FIG. 4, the insulator 16 defines a number of long passageways 18 and a number of short passageways 20 alternatively extending in a front-to-rear direction. A blade section 26 is formed on a front portion of the insulator 16. The blade section 26 includes a number of parallel spaced engagement projections 32 for engagement with corresponding notches 72 (best seen in FIG. 2) defined in the coupling section 70. The insulator 16 further includes two recesses 34 beside the blade section 26 for receiving the coupling section 70, two pairs of mounting ears 36 for receiving the two screws 110, and two pairs of mounting posts 38 vertically formed between the mounting ears 36 for mounting the two spacers 48, 50 onto the insulator 16 by extending the mounting posts 38 into holes 64 (best seen in FIG. 2) defined in the spacers 48, 50.

Figure 5:
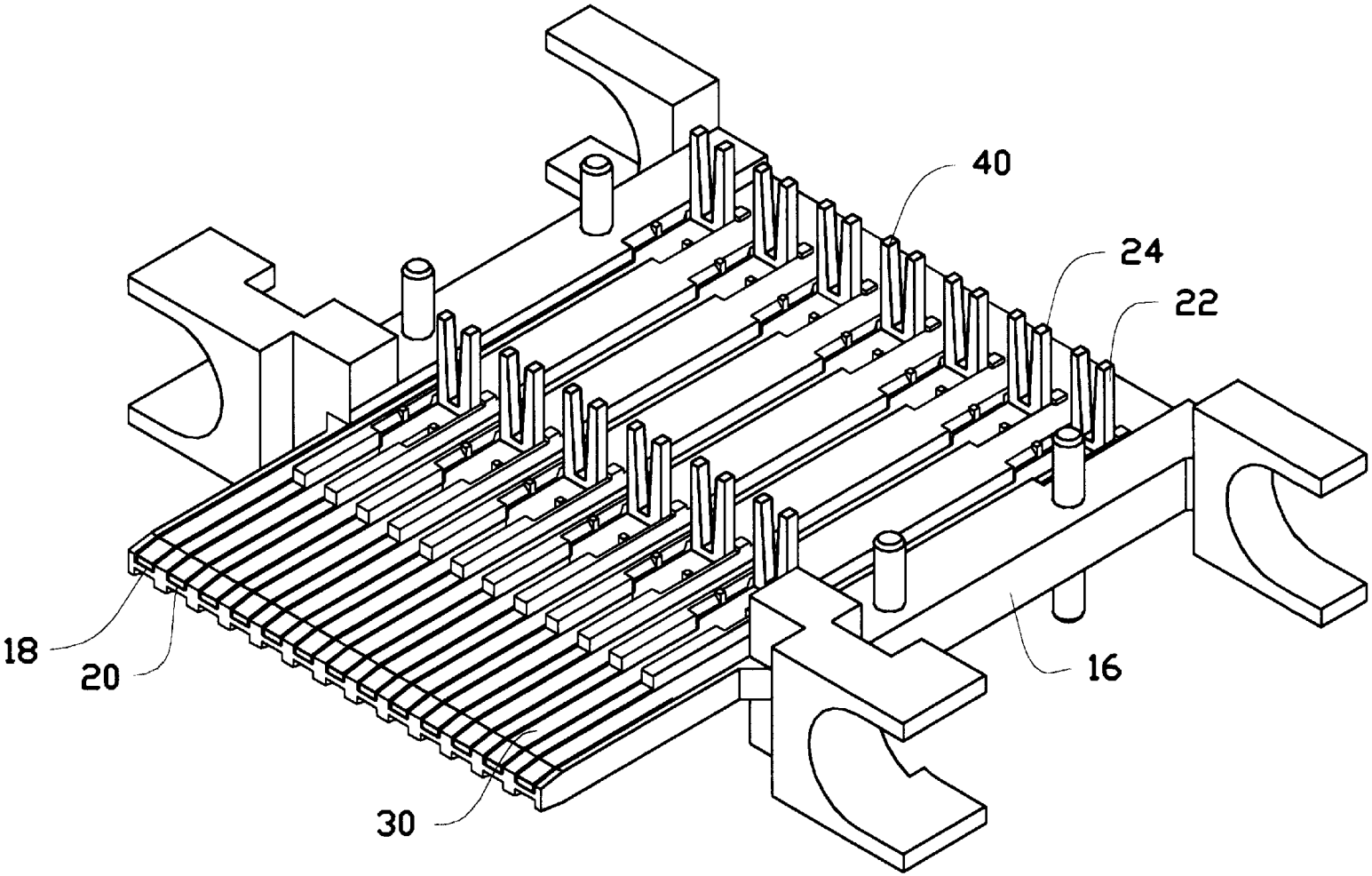
FIG. 5 is a view similar to FIG. 4 with a number of contacts mounted to the insulator.

Also referring to FIG. 5, each of the contacts 22, 24 has a contact portion 30 at a front portion thereof and a terminal portion 40 at a rear end thereof, wherein the contact portions 30 are used for engaging corresponding contacts in a mating connector (not shown), and the terminal portions 40 are used for connecting with the corresponding wires 46 of the cable 14. Each of the contacts 22, 24 further includes a barb-like retention portion (not shown), whereby the contacts 22, 24 can be fixedly mounted in the corresponding passageways 18, 20 by an interferential fit between the retention portions and the insulator 16.

Figure 6:
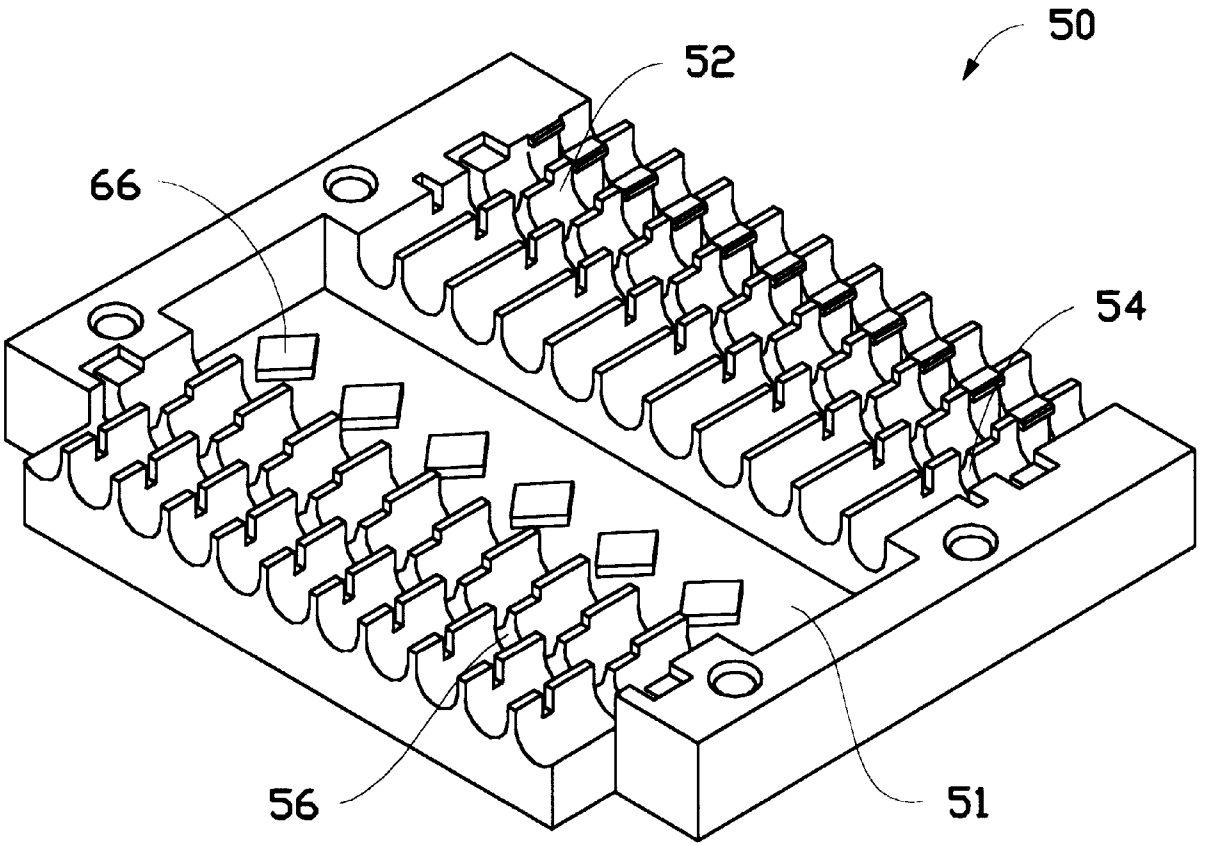
FIG. 6 is an enlarged perspective view of a lower spacer.

Also referring to FIG. 6, a detailed structure of the lower spacer 50 is shown, wherein the upper spacer 48 has a similar structure. The lower spacer 50 defines a number of receiving troughs 52 which are aligned with the corresponding passageways 18, 20 when the lower spacer 50 is mounted to the insulator 16. A first slit 54 is laterally defined in a rear portion of the lower spacer 50, a second slit 56 is laterally defined in a front portion thereof, and a recess 51 is laterally defined in a middle portion thereof. Six rectangular engaging blocks 66 protrude upwardly from the middle portion of the spacer 50 into the recess 51.

Figure 7:
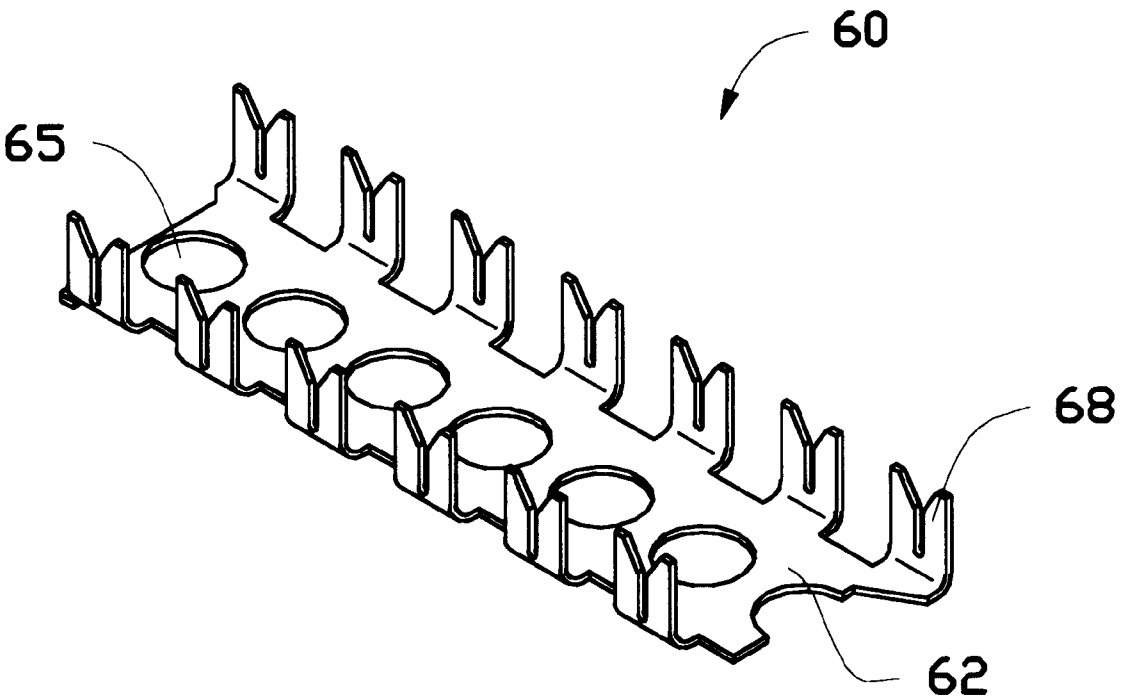
FIG. 7 is an enlarged perspective view of a shorting bar.

Also referring to FIG. 7, the shorting bar 60 includes a base plate 62 defining six engaging holes 65 therein and forming a number of piercing lances 68 extending upwardly from two sides thereof.

To assemble the cable connector assembly 10 in accordance with the present invention, the contacts 22, 24 are fixed to the insulator 16 as shown in FIG. 5. The shorting bar 60 is fixedly mounted to the recessed middle portion of the lower spacer 50 by interferentially extending the engaging blocks 66 through the corresponding engaging holes 65. Some of the piercing lances 68 are selectively removed from the base plate 65 or bent away from the vertical orientation in accordance with a specified requirement.

Figure 8:
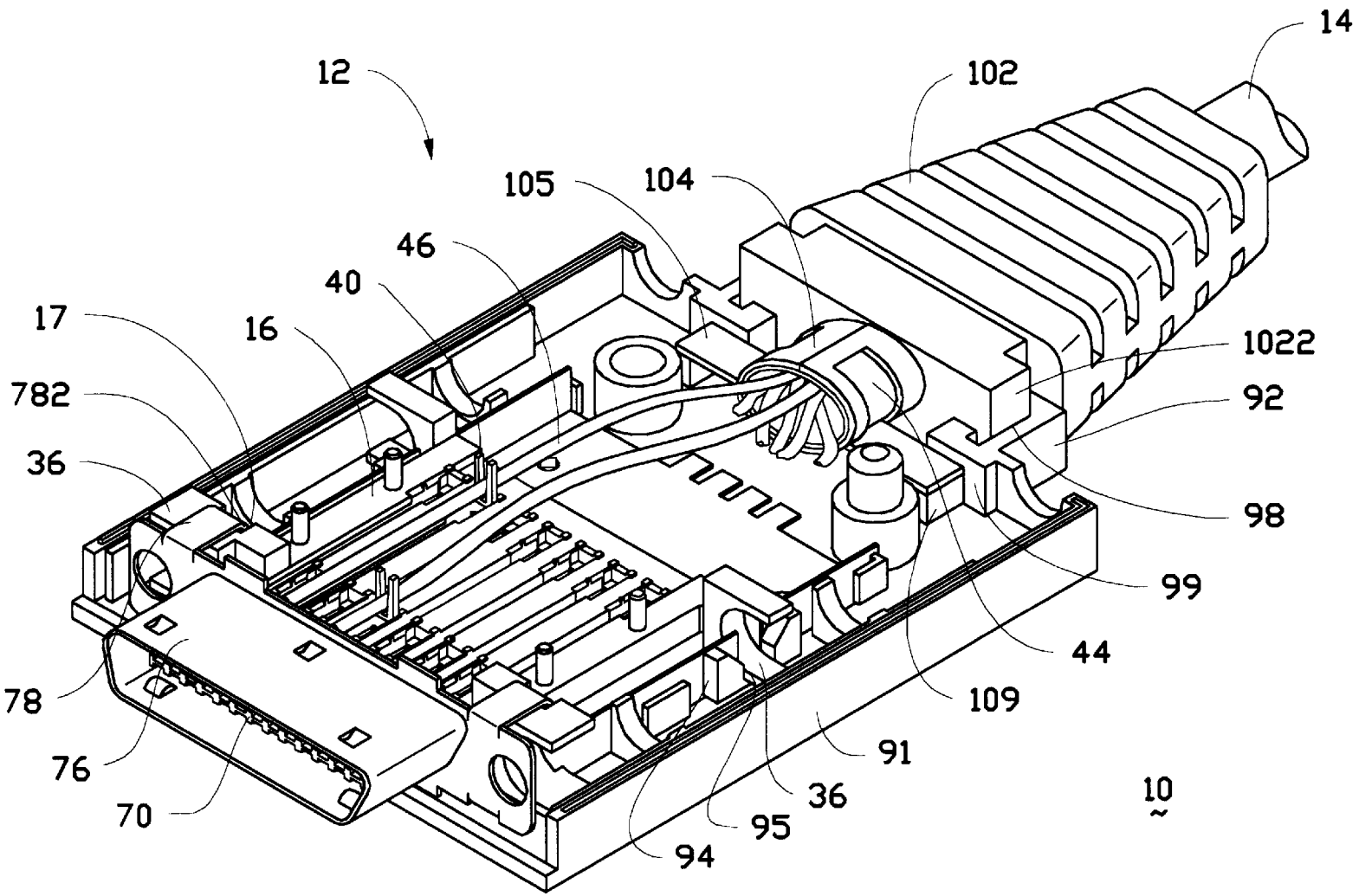
FIG. 8 is an enlarged perspective view of the partially assembled cable connector assembly in accordance with the present invention wherein an upper spacer, an upper shielding shell, an upper housing member and two screws are removed therefrom.

The metal strain relief 103 is fixed to the front end 44 of the cable 14 by crimping the body portion 104 thereonto. Some of the wires 46 of the cable 14 are placed onto the corresponding terminal portions 40 of the contacts 22, 24 located on a top face of the insulator 16 in accordance with a predetermined pattern. The upper spacer 48 is mounted to the top face of the insulator 16 by interferentially extending the mounting posts 38 through the mounting holes 64. At the same time, the terminal portions 40 pierce the wires 46 to cause the terminal portions 40 to electrically engage with leads (not shown) in the wires 46 (best seen in FIG. 8). The wires are received in the receiving troughs 52, and the terminal portions 40 are received in the slits 54, 56. For clarity, only two wires connecting with two contacts are shown in FIG. 8. The other wires 46 are then placed onto the corresponding terminal portions 40 of the contacts 22, 24 located on a bottom face of the insulator 16. The lower spacer 50 is mounted to the bottom face of the insulator 16 by interferentially extending the mounting posts 38 through the mounting holes 64. At the same time, the terminal portions 40 pierce the wires 46 to cause the terminal portions 40 to electrically engage with leads in the wires 46. In addition, the piercing lances 68, which remain vertically extending from the base plate 62, pierce selected wires thereby shorting the wires together in accordance with a specified requirement.

Figure 9:
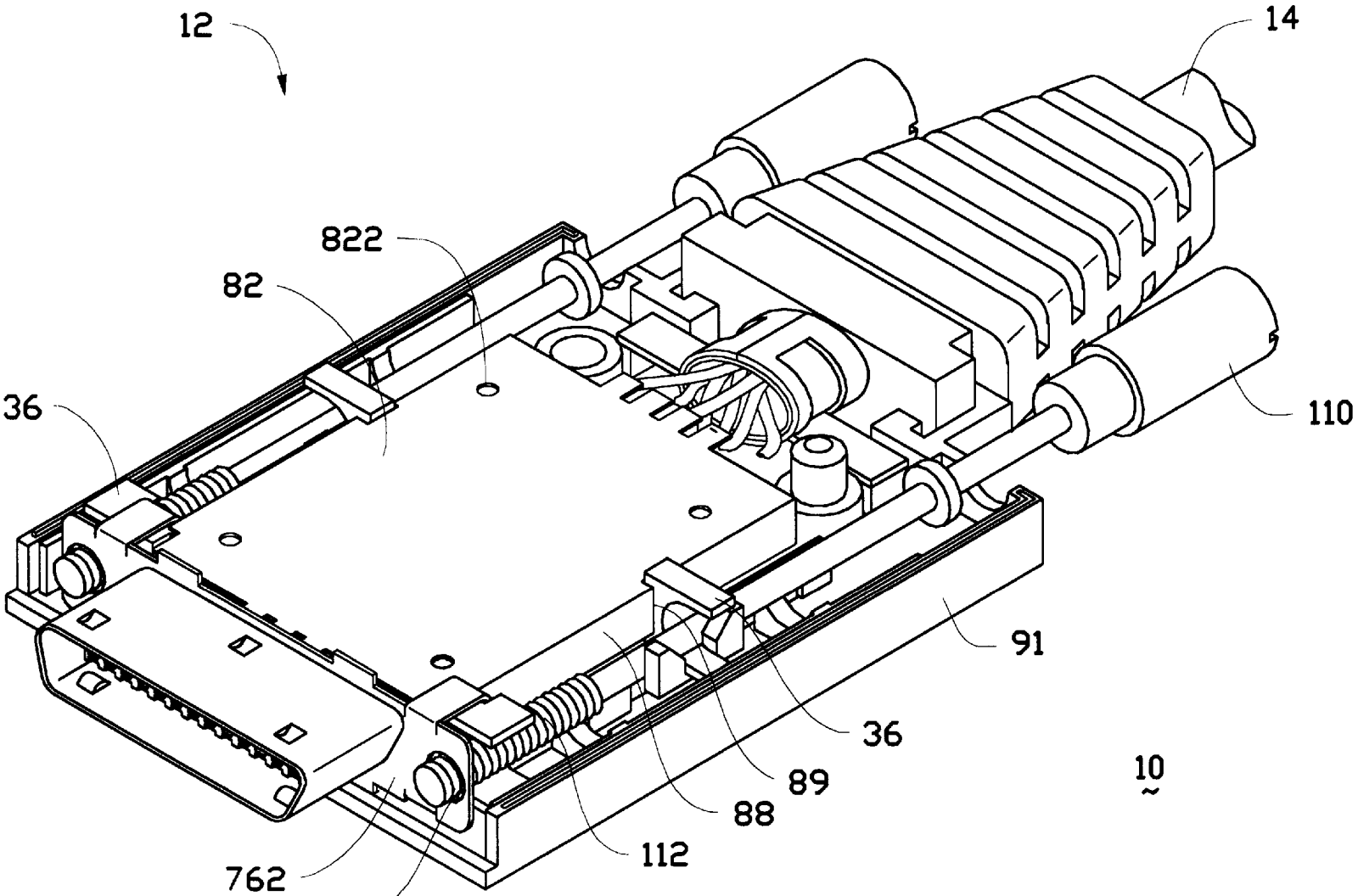
FIG. 9 is a view similar to FIG. 8 with only the upper housing member removed therefrom.

The coupling section 70 is then mounted onto the blade section 26 by moving the notches 72 along the engagement projections 32 until two lateral sides 702, 704 (best seen in FIG. 2) of the coupling section 70 are received in the recesses 34 beside the blade section 26, and a wall of the coupling section 70 defining the notches 72 is fixedly engaged with the engagement projections 32 of the blade section 26. Afterwards, the shell 76, which has four rearwardly extending fastening tabs 78, is mounted to the coupling section 70 and the insulator 16 by fixedly fitting a rear bent portion 782 of each of the fastening tabs 78 into a corresponding recess 17 defined in each of the front mounting ears 36 of the insulator 16 (FIGS. 2 and 8). The shell 76 electromagnetically shields the contact portions 30 of the contacts 22, 24. Finally, the upper and lower shielding shells 82, 84 are brought to interconnect to cover the upper and lower spacers 48, 50, and the rear mounting ears 36 fittingly extend through notches 89 defined in side walls 88 of the shielding shells 82, 84 (FIGS. 2 and 9). Thus, the assembly of the cable 14, the metal strain relief 103, the contacts 22, 24, the insulator 16, the coupling section 70, the shell 76, the spacers 48, 50, the shorting bar 60 and the shielding shells 82, 84 forms a subassembly for the cable connector assembly 10.

The subassembly is then mounted to the lower housing member 91 by extending four protrusions 100 formed on an inner face 911 of the lower housing member 91 into four alignment holes 87 defined in the lower shielding shell 84 (FIG. 2), and by fitting the rear mounting ears 36 into grooves 95 defined by locating blocks 94 formed on the inner face 911 of the lower housing member 91 (also referring to FIG. 8). The two fitting wings 105 of the metal strain relief 103 are respectively placed on two supports 109 formed on the lower housing member 91, wherein rear edges (not labeled) of the fitting wings 105 abut stop walls 99 formed by two generally U-shaped mounting blocks 92 at a rear end of the lower housing member 91. The two keys 1022 of the plastic strain relief 102 are engagably and respectively received in two grooves 98 defined by the two mounting blocks 92, respectively (FIGS. 2 and 8). The two screws 110 are received in the mounting ears 36, wherein threaded portions 112 of the screws 110 extend through two holes 107 defined in two ears 762 of the shell 76 (FIGS. 2 and 9) for threadedly connecting the cable connector assembly 10 to the mating connector (not shown). Finally, the upper housing member 90 is assembled with the lower housing member 91 by interferentially extending two connecting posts 96 respectively formed on the upper and lower housing members 90, 91 into two corresponding sleeves 97 also respectively formed thereon, and extending four protrusions (not shown) formed on an inner face of the upper housing member 90 into four alignment holes 822 (FIG. 9) defined in the upper shielding shell 82.

Through cooperation between the metal and plastic strain reliefs 102, 103, a large withdrawal force acting on the cable 14 relative to the connector 12 can be effectively transmitted to the housing of the connector 12 to prevent the withdrawal force from directly affecting the connection between the leads of the cable 14 and the contacts 22, 24 of the connector 12.

Furthermore, if the plastic strain relief 102 is eliminated from the preferred embodiment, the metal strain relief 103 can still effectively withstand the withdrawal force by itself due to its rigidity.

The metal strain relief 103 has a simple structure, can be easily mounted to the cable 14 and the housing of the connector 12, and can effectively withstand a large withdrawal force; thus, it qualifies to be granted a patent.

While the present invention has been described with reference to the specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A cable connector assembly, comprising:

a connector including a housing and a number of contacts fixed to the housing;

a cable including a number of leads connected to the contacts; and a metal strain relief having a body portion crimped to fixedly connect with the cable, and fitting means for fittingly engaging within the housing to withstand a withdrawal force acting on the cable relative to the housing thereby preventing a separation of the leads from the contacts due to the withdrawal force, said fitting means comprising two fitting wings extending from opposite sides of the body portion;

wherein the fitting wings are aligned to each other;

wherein the fitting wings are integrally formed with the body portion by a stamping operation to define two holes in the body portion, each hole having a shape complementary to that of a corresponding fitting wing;

wherein each fitting wing has a substantially rectangular configuration;

a plastic train relief fixedly attached to the cable by insert molding, said plastic train relief fixedly engaging with the housing of the connector;

wherein said housing forms two supports and two stop walls, and wherein the fitting wings are placed on the supports and abut the stop walls.

* * * * *